US006354065B1

(12) United States Patent
Horton et al.

(10) Patent No.: US 6,354,065 B1
(45) Date of Patent: Mar. 12, 2002

(54) DEVICE AND METHOD FOR PACKAGING SYSTEM SETUP MATERIALS

(75) Inventors: Beryl Hamilton Horton; Donna Moore; John Terwilliger, all of Austin, TX (US)

(73) Assignee: Dell Products, LP, Round Rock, TX (US)

( * ) Notice: Subject to any disclaimer, the term of this patent is extended or adjusted under 35 U.S.C. 154(b) by 0 days.

(21) Appl. No.: 09/373,829

(22) Filed: Aug. 13, 1999

(51) Int. Cl.[7] ..... B65B 43/26
(52) U.S. Cl. ..... 53/564; 206/576
(58) Field of Search ..... 53/449, 445, 446, 53/458, 474, 485, 564; 206/576, 232

(56) References Cited

U.S. PATENT DOCUMENTS

| | | | | | |
|---|---|---|---|---|---|
| 2,441,445 | A | * | 5/1948 | Ringler et al. | 53/456 |
| 4,640,413 | A | * | 2/1987 | Kaplan et al. | 206/232 |
| 4,925,087 | A | | 5/1990 | Ostrander | |
| 5,133,459 | A | | 7/1992 | Genix | |
| 5,143,217 | A | | 9/1992 | Igarashi | |
| 5,394,981 | A | * | 3/1995 | Cameron | 206/232 |
| 5,396,985 | A | | 3/1995 | Seki | |
| 5,568,863 | A | | 10/1996 | Weavers | |
| 5,775,494 | A | * | 7/1998 | Taplin | 206/308.2 |
| 5,890,602 | A | | 4/1999 | Schmitt | |
| 5,944,183 | A | * | 8/1999 | Rowland et al. | 206/313 |
| 6,182,823 | B1 | * | 2/2001 | Rinde | 206/232 |

FOREIGN PATENT DOCUMENTS

| | | | | |
|---|---|---|---|---|
| GB | 2079726 A | * | 1/1982 | 206/323 |

* cited by examiner

*Primary Examiner*—Scott A. Smith
*Assistant Examiner*—John Paradiso
(74) *Attorney, Agent, or Firm*—Russell D. Culbertson; Shaffer & Culbertson, LLP

(57) ABSTRACT

A packaging device (10) includes two separate container portions. A first container portion (11) contains general documentation, while a second container portion (15) contains system setup material (30) having setup indicia (31) such as a COA which is required for setting up or installing the subject equipment. The second container portion (15) includes a window (22) through which the setup indicia (31) is visible when the material (30) is properly received in a display position. A locking arrangement (38) may be included with the second container portion (15) for locking the setup material (30) in the proper display position. Also, the packaging device (10) may include identifying indicia (35) printed on an exterior surface adjacent to the window (22) for drawing the customer's attention to the important setup indicia (31) visible through the window.

16 Claims, 4 Drawing Sheets

DEVICE AND METHOD FOR PACKAGING SYSTEM SETUP MATERIALS

TECHNICAL FIELD OF THE INVENTION

This invention relates to packaging and, more particularly, to packaging for documentation and setup material shipped with equipment such as computer systems. The invention encompasses both a packaging device and a method of the packaging documentation and setup material.

BACKGROUND OF THE INVENTION

Many types of equipment, particularly computer systems, are shipped to the user in packaging which contains both the equipment and the documentation for the equipment. For example, computer systems are commonly shipped in a package which includes the various components of the computer system, together with a separate "options" box. The options box contains documentation for the particular system including documentation for optional devices incorporated in the system. Initial system setup information may also be contained in the options box. The setup material required for initially setting up or installing the computer system may include a certificate of authenticity or COA for the operating system software. The COA includes a serial number which the customer must use to set up the system.

For many types of equipment, the documentation may include numerous materials ranging from voluminous manuals to single sheet notices and compact discs or diskettes containing software programs. Any one document, including a critical setup document, may be easy to overlook or lose in this mass of material. Thus, the customer may be unable to locate the required setup information and may eventually contact customer support for assistance. This not only increases customer support costs, but may also lead to customer dissatisfaction with the product.

In the computer system situation is possible to print or otherwise affix the COA on the outside of a documentation package to be shipped with the computer system. However, affixing the COA to the documentation package presents synchronization and tracking problems for the manufacturer. In particular, since the documentation package has the COA printed on its exterior, the package is specific to a particular computer system and must be tracked through the manufacturing facility. Tracking this type of documentation package through the system manufacturing or assembly process is necessary to ensure that the correct documentation goes into the correct documentation package and to ensure that the correct documentation package is shipped with the correct computer system.

SUMMARY OF THE INVENTION

It is an object of the invention to provide a packaging device and packaging method which overcome the above-described problems and others associated with packaging documentation and setup materials for various types of equipment, including computer systems.

A packaging device according to the present invention includes two separate container portions. A first container portion contains general documentation, while a second container portion contains system setup material having setup indicia such as a COA which is required for setting up the subject equipment. The second container portion includes a window through which the setup indicia is visible when the material is properly received in a display position. A locking arrangement may be included with the second container portion for locking the setup material in the proper display position. Thus, the customer may readily locate the required setup indicia simply by looking through the window in the packaging device. Also, the packaging device may also include identifying indicia printed on an exterior surface adjacent to the window for drawing the customer's attention to the important setup indicia visible through the window.

In the preferred form of the invention, the second container portion is formed within the first container, with both container portions sharing a common outer wall in which the window is formed. Each container portion has a separate access opening through which material may be inserted. Also, both access openings are preferably located on a common side of the packaging device and lie generally in a common plane. A cover arrangement is included with the packaging device to cover the access openings. In the preferred form of the invention, a single lid covers both access openings simultaneously and a fastening arrangement is included for releaseably fastening the lid in a closed position.

These and other objects, advantages, and features of the invention will be apparent from the following description of the preferred embodiments, considered along with the accompanying drawings.

DESCRIPTION OF THE PREFERRED EMBODIMENTS

Figure 1:
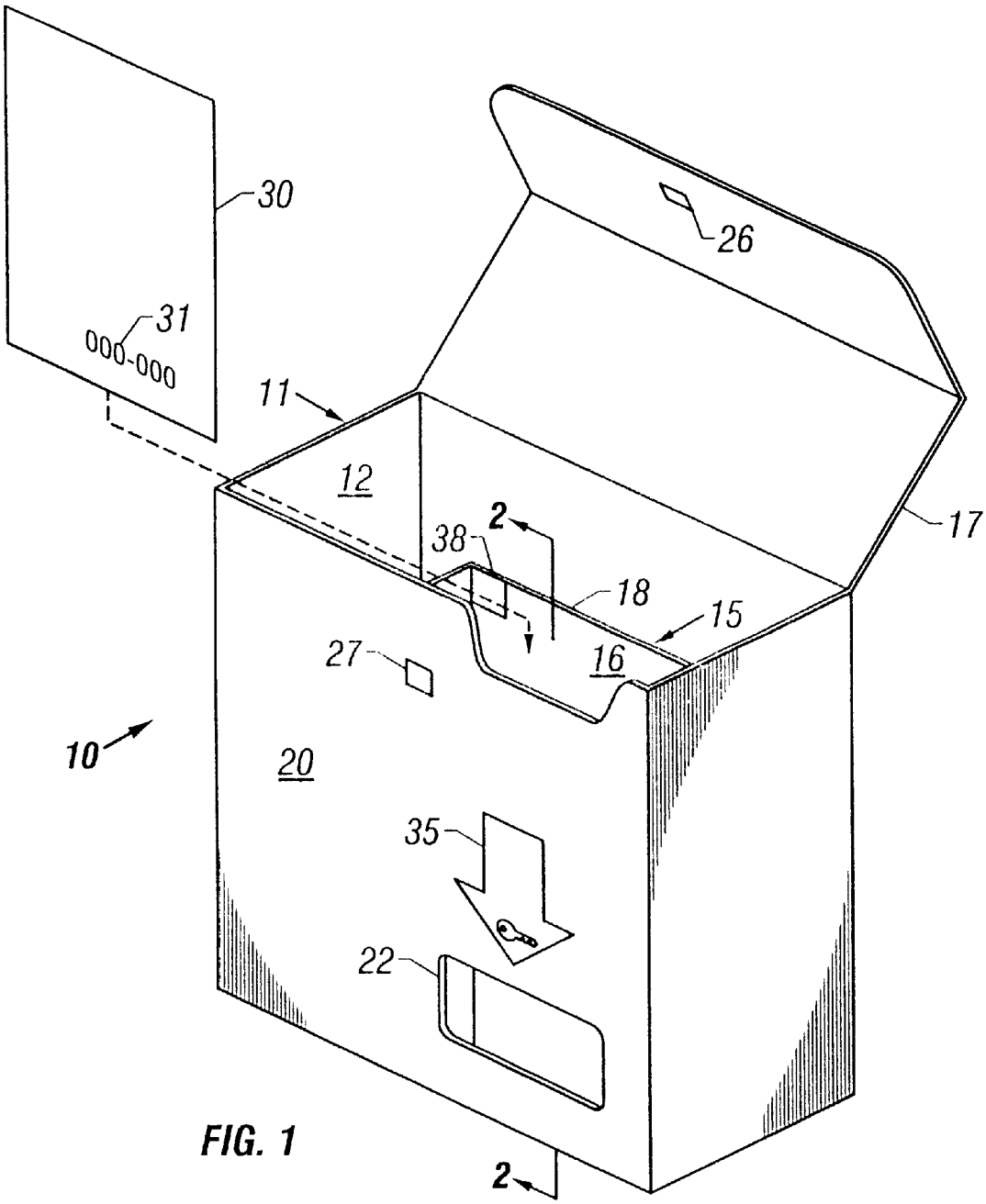
FIG. 1 is a view in perspective of a packaging device embodying the principles of the invention, with a lid shown in an open position.
Figure 2:
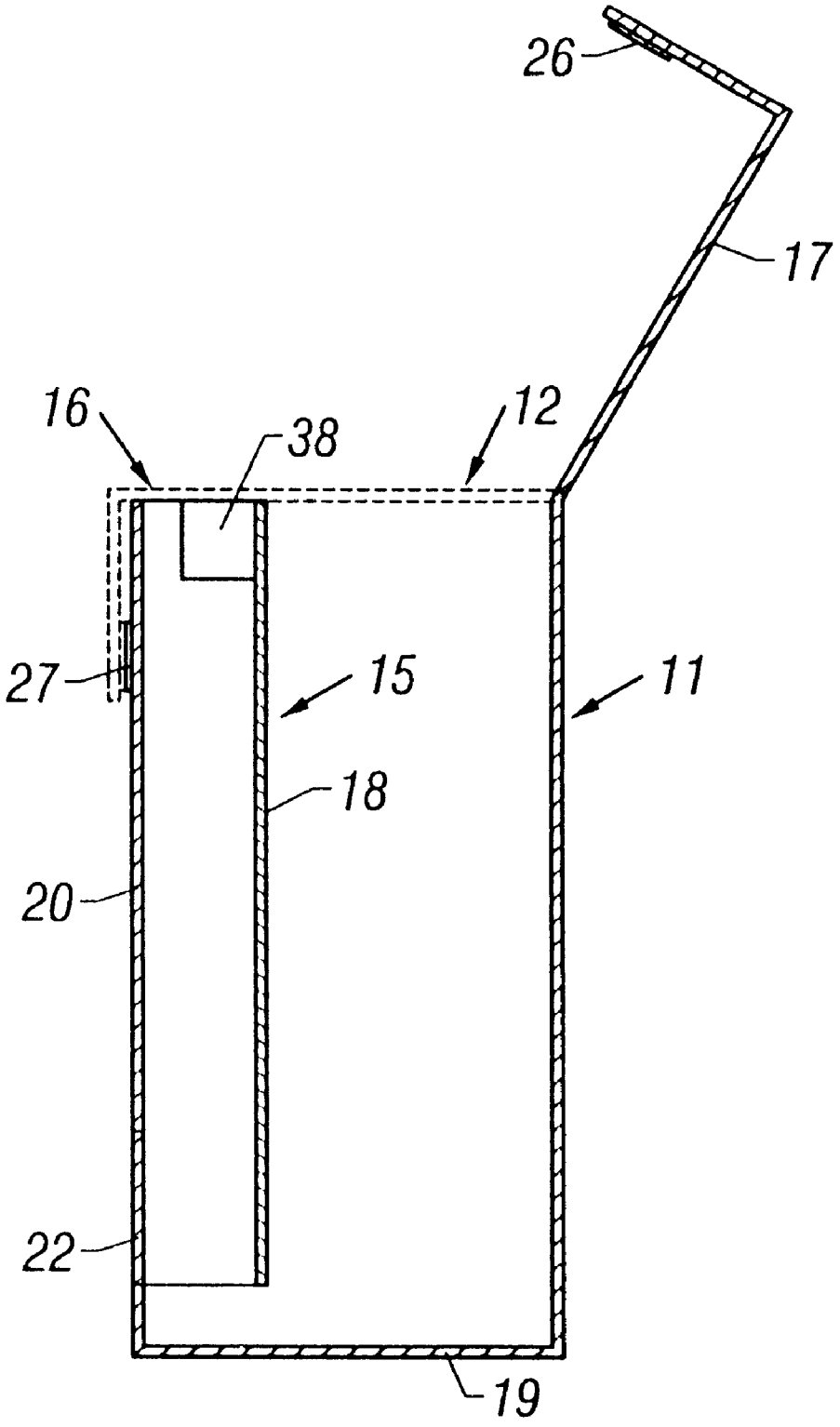
FIG. 2 is a view in section taken along lines 2—2 in FIG. 1, with the lid also shown in a closed position using phantom lines.
Figure 3:
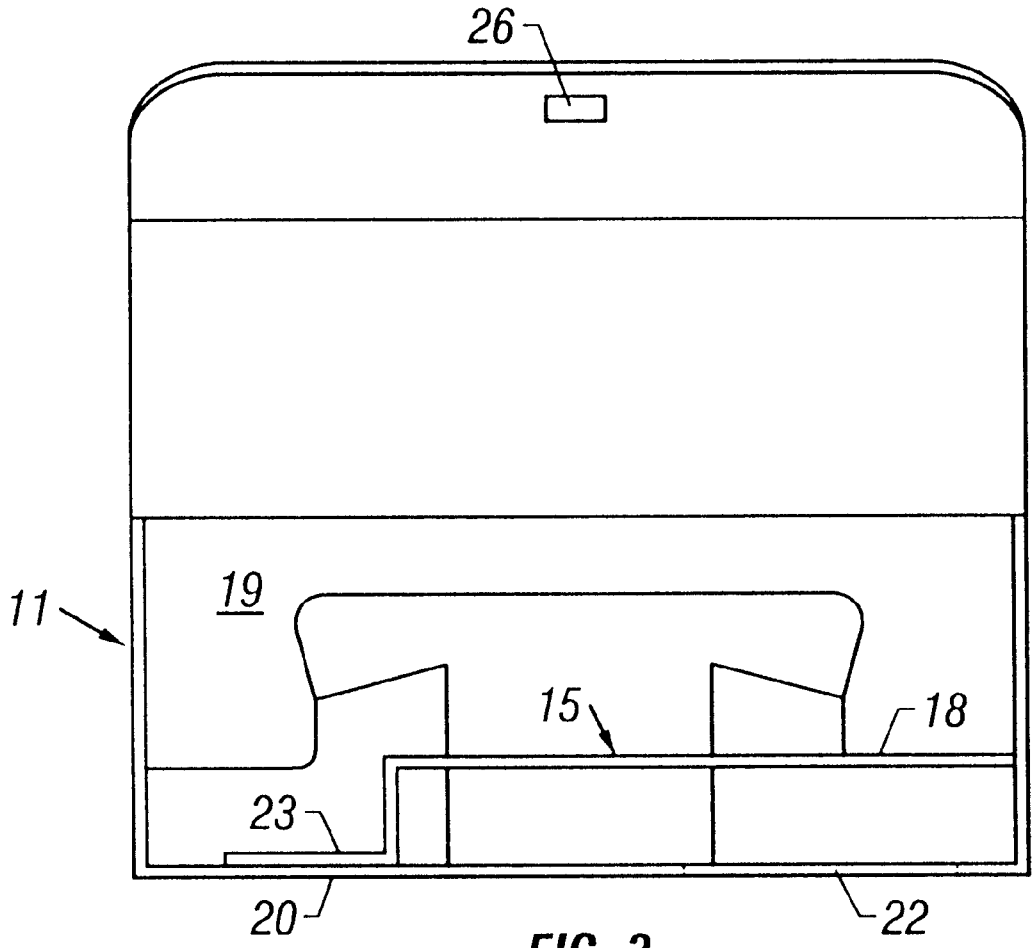
FIG. 3 is a top view of the packaging device with the lid removed.

FIGS. 1 through 3 show a packaging device 10 embodying the principles of the invention. Packaging device 10 includes a first container portion shown generally at reference numeral 11 and having a first access opening 12. Packaging device 10 also includes a second container portion shown generally at 15 with a second access opening 16. A cover arrangement preferably comprising lid 17 is adapted to cover the first and second access openings, 12 and 16 respectively.

Although second container portion 15 may be formed separately and connected to first container portion 11, the second container portion is preferably formed within the first container portion. In this preferred form of the invention, second container portion 15 may be defined by the divider wall 18, and both the first container portion 11 and second container portion share a common outer wall 20. A display window 22 is formed in an outer wall of second container portion 15 and preferably in common wall 20. Window 22 may comprise simply a cutout area or an area of transparent material, and is adapted to display important equipment setup information as will be discussed in detail below.

The preferred packaging device 10 is made from a relatively rigid and durable material such as cardboard for example. However, the device may be formed from any suitable material including suitable plastics and other materials. Although the walls which make up packaging device 10 are preferably rigid, the device may be constructed from flexible materials within the scope of the invention. When cardboard is used to build the device, a flat sheet of material may be cut and folded to produce the illustrated package. Techniques of building boxes and other containers from a flat sheet of cardboard or other material are well-known in the art and will not be discussed here in detail. Those skilled in the art will appreciate that numerous different patterns may be used to produce the packaging device 10 shown in the drawings. Also, although the preferred packaging device 10 may be assembled primarily by folding the flat material, adhesives or tape (not shown) may be required at some points. For example, the bottom 19 of the packaging device 10 may be formed solely by folding flaps of material together. Alternatively, the flaps of material may be connected together with a tape or adhesive. An adhesive material is preferably used to connect one edge 23 of divider wall 18 to the common wall 20.

In the embodiment of the invention shown in FIGS. 1 through 3, the first container access opening 12 and second container access opening 16 are positioned on a common side of packaging device 10. Also, access openings 12 and 16 are preferably aligned generally in a common plane shown at line P in FIG. 2. This access opening arrangement for the two container portions 11 and 15 facilitates the use of the single lid 17 for covering both access openings simultaneously. However, those skilled in the art will appreciate that embodiments of the invention may include a cover arrangement having separate lids for covering the two access openings 12 and 16. These multiple lid arrangements should be considered equivalent to the illustrated single lid arrangement. In any event, a fastening arrangement is associate with each lid for fastening the respective lid in a closed position. This closed lid position is shown in phantom in FIG. 2. A preferred fastening arrangement may include a loop and hook type or VELCRO fastener with one element 26 connected to the lid 17 and the opposing element 27 connected to an outer surface of the packaging device.

The preferred lid 17 comprises a single, solid piece of material which is hinged to the remainder of packaging device 10. The single, solid lid 17 provides superior protection for the material placed in the first and second container portions, 11 and 15 respectively. Alternate forms of the invention may included one or more straps which connect over the access openings 12 and 16 to retain material in the two container portions 11 and 15.

First container portion 11 is adapted to receive and hold documentation materials (not shown). For example, packaging device 10 is particularly adapted for containing documentation such as user's manuals and related material. In this example, first container portion 11 is adapted to contain the user's manuals, software diskettes, or other material commonly shipped with equipment such as a computer system.

Second container portion 15 is adapted to receive setup material for certain equipment. The setup material includes an item 30 which is printed or otherwise marked with setup indicia 31 as shown in FIG. 1. When the setup material item 30 is received in second container portion 15 in a display position, the setup indicia 31 is visible through window 22. For example, packaging device 10 may be adapted for containing documentation and setup materials relating to a computer system, and second container portion 15 may be adapted for receiving a sheet of material bearing the certificate of authenticity or COA for the operating system software loaded on the computer system. This COA may include a product code and is commonly required in the initial system setup. When this setup material item 30 is properly received in the display position in second container portion 15, the invention allows the user to easily locate the COA without even opening the documentation package.

Packaging device 10 may further include identifying indicia 35 printed or otherwise formed adjacent to window 22. This identifying indicia 35 draws the user's attention to window 22 and may also identify the setup indicia 31 as such, or at least identify the setup indicia as important information.

A locking arrangement may be associated with second container portion 15 for locking the setup material and item 30 in the display position. The preferred locking arrangement comprises a corner cut-out 38 formed in divider wall 18. This corner cut-out 38 may be bent inwardly to extend into the area of the second access opening 16. Although corner cut-out 38 comprises a preferred locking arrangement, numerous other locking arrangements may be used within the scope of the invention. These alternate locking arrangements for contacting and holding the setup material item 30 in the desired display position are to be considered equivalents to the corner cut-out 38 shown in FIGS. 1 through 3 for purposes of example.

Packaging device 10 provides numerous advantages for manufacturers or assemblers of devices such as computer systems which are commonly shipped with extensive documentation materials and setup materials. Foremost among these advantages is that the packaging device 10 provides user access to the operating system COA without requiring that the user open the packaging device and search through the other documentation materials. When packaging device 10 is made from a rigid material, it also provides a convenient receptacle for storing documentation associated with the particular equipment. The rigid-walled device may stand upright on a shelf or bookcase, readily accessible to the user.

Packaging device 10 also provides advantages in system or equipment assembly. The device may be passed from one assembly station to another along with the equipment being built so that the appropriate documentation may be added as the subject equipment is assembled. Where the equipment being manufactured or assembled is a computer system, the material having the COA may be added at the time the operating system is loaded to ensure that the correct COA is shipped with the correct system. Furthermore, packaging device 10 may have an exterior design which allows it to be used with numerous different types of equipment. For example, the identifying indicia 35 may simply indicate that the setup indicia 31 is important setup information. Also, the exterior of the device 10 may be printed with the word "documentation" in several different languages. Thus, the identical packaging device 10 may be used for containing documents for many different types of systems, shipped to may different locations. This reduces production and inventory costs relating to the packaging device 10.

Figure 4:
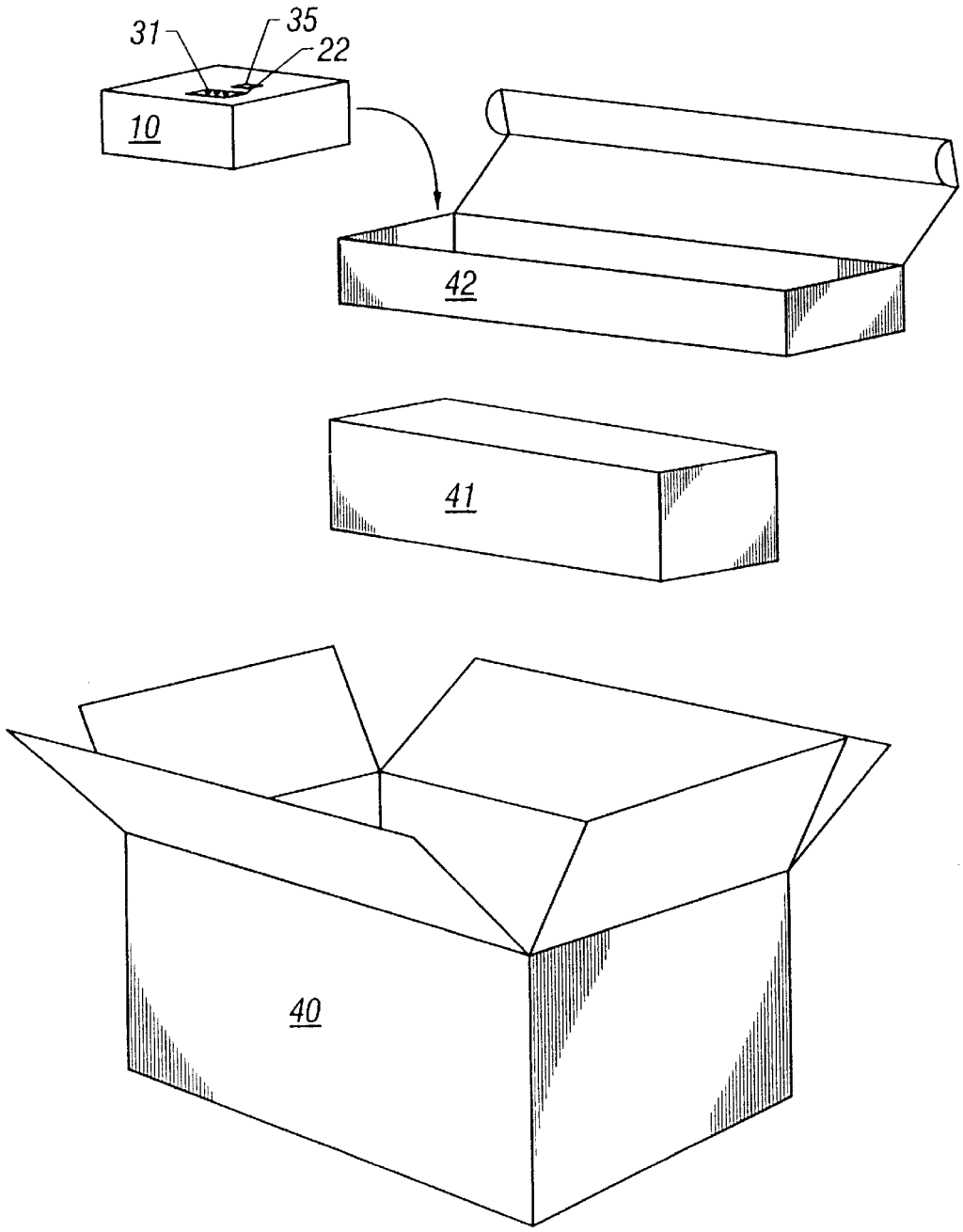
FIG. 4 is a view in perspective showing how the packaging device in FIG. 1 may be placed in a secondary package within a computer system shipping package.

FIG. 4 shows the preferred manner in which packaging device 10 is included for shipment with a computer system. The computer system is shipped in a system box 40 which is sized to house system components such as the central processing unit 41, along with a secondary package or options box 42. Packaging device 10 is preferably sized to fit within options box 42.

The above described preferred embodiments are intended to illustrate the principles of the invention, but not to limit the scope of the invention. Various other embodiments and modifications to these preferred embodiments may be made by those skilled in the art without departing from the scope of the following claims. For example, although the COA required to set up a computer system is used above as a specific example of setup indicia which may be displayed according to the invention, the setup indicia may include other types of indicia. For example, the setup indicia may include a registration code by which the equipment may be registered when first installed. The setup indicia may also comprise or include an access code which may be used to access information regarding the equipment.

What is claimed is:

1. A packaging device for use in the packaging material associated with a computer system, the material including system setup material having system setup indicia located thereon, the packaging device comprising:

(a) a first container portion having a first access opening;

(b) a second container portion associated with the first container portion and having a second access opening, the second container portion for receiving the system setup material in a display position; and (c) a window formed in an outer wall of the second container portion, the window aligning with the system setup indicia when the system setup material is in the display position so that the system setup indicia shows through the window while other portions of the setup material remain obscured by the outer wall of the second container portion.

2. The packaging device of claim 1 further comprising:

(a) a cover arrangement for covering the first access opening and the second access opening.

3. The packaging device of claim 1 wherein the first access opening and the second access opening are located on a common side of the packaging device.

4. The packaging device of claim 3 further comprising:

(a) a lid adapted to selectively reside in a closed position simultaneously covering both the first access opening and the second access opening.

5. The packaging device of claim 4 further comprising:

(a) a fastening arrangement associated with the lid for fastening the lid in the closed position.

6. The packaging device of claim 3 wherein the first access opening and the second access opening are aligned in a common plane.

7. The packaging device of claim 1 further comprising:

(a) a locking arrangement associated with the second container portion for locking the setup material in the display position.

8. The packaging device of claim 1 wherein the second container portion is located within the first container portion with the second container outer wall also being a wall of the first container.

9. The packaging device of claim 1 further comprising:

(a) identifying indicia located on an outer surface of the second container portion outer wall, the identifying indicia comprising information identifying the setup indicia visible through the window in the second container portion.

10. A packaging device comprising:

(a) a first container portion having substantially rigid outer walls and a first access opening;

(b) a second container portion formed within the first container portion and having a second access opening, the second container portion sharing a common outer wall with the first container portion and being adapted to receive material in a display position;

(c) a window formed in the common outer wall, the window being located on the outer wall so that indicia located on the material shows through the window when the material is received in the display position in the second container portion; and (d) identifying indicia located on an outer surface of the common outer wall, the identifying indicia comprising information identifying the indicia visible through the window.

11. The packaging device of claim 10 further comprising:

(a) a cover arrangement for covering the first access opening and the second access opening.

12. The packaging device of claim 10 wherein the first access opening and the second access opening are located on a common side of the packaging device.

13. The packaging device of claim 12 further comprising:

(a) a lid adapted to selectively reside in a closed position simultaneously covering both the first access opening and the second access opening.

14. The packaging device of claim 13 further comprising:

(a) a fastening arrangement associated with the lid for fastening the lid in the closed position.

15. The packaging device of claim 12 wherein the first access opening and the second access opening are aligned in a common plane.

16. The packaging device of claim 10 further comprising:

(a) a locking arrangement associated with the second container portion for locking the material in the display position.

* * * * *